US005985192A

United States Patent [19]

Weihrauch

[11] Patent Number: 5,985,192

[45] Date of Patent: Nov. 16, 1999

[54] PROCESS FOR THE MANUFACTURE OF SPIRALLED BRISTLES

[75] Inventor: Georg Weihrauch, Wald-Michelbach, Germany

[73] Assignee: Coronet-Werke GmbH, Wals-Michelbach, Germany

[21] Appl. No.: 09/029,899

[22] PCT Filed: Sep. 4, 1996

[86] PCT No.: PCT/EP96/03874

§ 371 Date: Aug. 11, 1998

§ 102(e) Date: Aug. 11, 1998

[87] PCT Pub. No.: WO97/10374

PCT Pub. Date: Mar. 20, 1997

[30] Foreign Application Priority Data

Sep. 13, 1995 [DE] Germany ..... 195 33 816

[51] Int. Cl.[6] ..... D01D 5/12; D01D 5/253; D01D 5/34; D01F 8/04

[52] U.S. Cl. ..... 264/78; 57/282; 57/310; 264/103; 264/172.12; 264/172.15; 264/177.13; 264/177.19; 264/210.5; 264/210.7; 264/210.8; 264/211.15; 264/211.17

[58] Field of Search ..... 264/78, 103, 172.12, 264/172.15, 177.13, 177.19, 210.5, 210.7, 210.8, 211.15, 211.17; 57/282, 310

[56] References Cited

U.S. PATENT DOCUMENTS 4,804,232 2/1989 Weihrauch ..... 300/21

FOREIGN PATENT DOCUMENTS 1140901 12/1962 Germany .
4114136 11/1992 Germany .

OTHER PUBLICATIONS

Abstract of Japan 3–289,906 (Dec. 19, 1991).

*Primary Examiner*—Leo B. Tentoni
*Attorney, Agent, or Firm*—Antonelli, Terry, Stout & Kraus, LLP

[57] ABSTRACT

The invention relates to a method for the manufacture of screwlike bristles by extruding monofilaments. In order to provide a method with which screwlike bristles can be inexpensively manufactured in the same way as conventional bristles with an identical, predeterminable quality, a monofilament having a non-circular cross-section is extruded and is prestretched after drawing off, accompanied by a reduction in its cross-section, followed by further stretching, twisting to a screwlike bristle material over at least part of its length and then stabilization by shrinkage. It is possible to extrude a monofilament with an oval or polygonal cross-section or having a core and at least one axially parallel rib. According to a further method, at least two monofilaments are prestretched on drawing off, accompanied by a reduction of their cross-section, followed by further stretching, twisting together to give a screwlike bristle material and stabilization by heat shrinkage.

18 Claims, No Drawings

PROCESS FOR THE MANUFACTURE OF SPIRALLED BRISTLES

BACKGROUND OF THE INVENTION

Field of the Invention

The invention relates to a method for the manufacture of screwlike bristles from plastic by extruding monofilaments.

Description of the Prior Art

Bristles for brushware of random types evolve their brushing action initially and mainly through the free ends of the bristles, which tear open the dirty surface and remove the dirt by scratching and scraping. When stronger pressure is exerted, the bristles bend round and act with their circumferential surface. They then have a stroking and sliding effect on the surface with a more gentle action.

Besides circular bristles with the aforementioned effects, profile bristles are also known, in which the profile edges have a stronger scraping action when the bristle is bent round. In addition, bristles for car wash brushes having a screwlike profile are known (DE-U-93 19 214, DE-A-1 140 901) where there is a very large pitch of the screws. This is once again intended to reduce the strong scraping action exerted by the profiled bristles, in that locally only a part of the helix is in engagement. Such a bristle with a steep helix can be obtained by twisting a monofilament with a substantially star-shaped cross-section. It is left open in the prior art how this is to take place and in particular lead to a stable bristle with a good re-righting capacity.

It is also known to provide the circumferential surface of conical bristles with a helix or spiral (DE-U-85 22 986). This takes place by the subsequent shaping of the helix or by extruding the bristle. This bristle has in particular the function in the case of hairbrushes the improvement and facilitating of the application of media. Extruded or subsequently profiled bristles must have a significant cross-section so as to ensure an adequate bending resistance. They are therefore pins rather than bristles.

It is finally known (DE-A-16 60 646) to manufacture helical fibers by extruding a monofilament under strong shear stress, so that melt fractures occur. Thus, the helical shape is directly produced at the extruder die and fixed by sudden cooling after the die. Due to the strong shear stress, which deliberately leads to melt fractures, as well as the sudden chilling of the still melt-plastic material, there is a significant deterioration to fiber stability. The fiber cannot be used as bristle material. It is also impossible to influence the pitch of the helix.

SUMMARY OF THE INVENTION

The problem solved by the invention is providing a method with the aid of which it is possible to manufacture screwlike bristles in the same, predeterminable quality as conventional bristles and in an inexpensive manner.

According to a first variant of the invention, the problem of the prior art is solved in that a monofilament is extruded with a cross-section diverging from the circular shape and on drawing off is prestretched, whilst reducing its cross-section, followed by further stretching and then at least part of its length is twisted to a screwlike bristle material and is stabilized by heat shrinkage after twisting. Prestretching takes place immediately on removing the monofilament at the extruder during further stretching after cooling, e.g. after monofilament passage through a water bath.

As a result of the prestretching and subsequent further stretching a profile bristle with strength characteristics such as are known in the case of conventional, unprofiled bristles. As a result of the subsequent twisting round the monofilament axis from the monofilament is obtained a screwlike or helical bristle material. The helix obtained in this way is acquired from the monofilament profile projecting over the circular shape and can either extend over the entire bristle length or only over part of the length thereof. Stabilization after twisting can take place in known manner by the action of an elevated temperature or by the storage of the wound, screwlike bristle material at ambient temperature or a higher temperature, in order to fix the bristle material in the desired shape.

Preferably, after further stretching and prior to twisting, the monofilament is prestabilized by heat shrinkage. During the prestabilization the monofilament is subject to heat action and then cooled, so that the monofilament shrinks. In conjunction with the further stabilization after twisting it is ensured that the monofilament twist is permanently fixed.

The monofilament produced by extrusion can have an oval or polygonal cross-section. In the case of an oval cross-section with a twisting center in the axis a bristle material is obtained with two helixes running over the surface.

With a polygonal cross-section, there is a number of helixes corresponding to the number of angles. Preferably a rectangular and in particular square cross-section is chosen, so that four helixes are formed on the circumferential surface or envelope.

Instead of this, it is possible to extrude and twist a monofilament with a core and at least one axially parallel rib. In this case a bristle material is obtained with helixes, whose height can be preselected in accordance with the rib height, so that comparatively deep channels are formed on the bristle.

For certain uses it must be ensured that a user recognizes as such brushes having particularly abrasively acting screwlike bristles and does not use the same in error, such as is e.g. the case with toothbrushes for the treatment of sensitive gums. In a further development of the invention at least one rib or at least one edge of the polygonal cross-section differs as regards color from the monofilament core, in that differently colored plastics are extruded, e.g. a bristle which is white or transparent in the core with a helix having a signal or marker color. If pigments are used for coloring purposes, the helix has a harder and at the same time abrasive surface.

Preferably the core and the at least one rib or at least one edge of the polygonal cross-section are made from different plastics. As a result the helix obtained can be adapted to specific use conditions, particularly with respect to its hardness. In the case of ribs made from a relatively soft material, it is e.g. possible to carefully remove dirt from carpets. A relatively hard material for the rib or ribs makes it possible, e.g. for tooth care purposes, to bring about an efficient cleaning of the teeth. An intensive brushing action, e.g. for removing rust, can be obtained with ribs made from abrasive material. Information can be given to the user regarding the brushing characteristics of the particular brush by a different colour design of the core and the ribs.

It is necessary with certain brushes for the bristles to have a predetermined stiffness. A stiffness adaptation can be obtained, in a preferred development of the invention, if the monofilament is extruded from a core and a surrounding envelope of different plastics. As a result of the choice of materials the core can e.g. have typical properties of a bristle with respect to the bending capacity, whereas the envelope has the most suitable characteristics for the intended use. The ribs on the envelope can either be made from the same material or from a different material.

Another solution to the problem solved by the invention is based on the extrusion of monofilaments with an e.g. circular cross-section. Such a method is characterized in that at least two monofilaments are prestretched on removal, accompanied by a reduction of their cross-section, are subsequently further stretched and then twisted together to give a spiral bristle material and are then stabilized by heat shrinkage after twisting.

Thus, in this case the screwlike profiled circumferential surface of the bristle is obtained through at least two twisted together monofilaments having a random cross-section. Their stability results from the manufacturing procedure conventionally used for bristles.

Here again the monofilaments can be stabilized by heat shrinkage following the further stretching and prior to twisting. This stabilization can also take place by the action of an elevated temperature or by storing the wound bristle material at ambient temperature or a higher temperature.

The brushing action is inter alia dependent on the extent of the twisting, relative to the effective length of a bristle or the bristle material, i.e. on the pitch of the helix formed as a result of twisting. It has been found that the helix pitch should not exceed twice the effective length of the bristle, so that along the effective length there is a helix passing round 180°. However, preferably the helix has a smaller pitch, which can extend up to the bristle material diameter. In the case of toothbrushes it has proved favorable to adopt a pitch, in which there are at least two and preferably three to five turns per cm of bristle length.

According to a further development of the invention, the monofilament or monofilaments are made from an elastic plastic. In this way the bristles produced from the bristle material can expand longitudinally, which leads to a reduction of their diameter, so that e.g. when used in toothbrushes or as interdental cleaners they can be introduced into a gap between the teeth, but cannot jam in the latter. On drawing out the bristle expands and can additionally twist.

The bristle material produced according to the invention can be used with particular advantage in numerous brushes. Thus, the deeper spaces located between the helixes on the surface are particularly suitable for receiving and storing the dirt detached during brushing and which is only discharged at the end of the brushing path. This advantageous action e.g. occurs with carpet brushes, vacuum cleaner brushes, polishing brushes, etc.

In addition, the spaces formed between the helixes can be used for holding media to be applied. This is e.g. the case with hairbrushes, painter's brushes, cosmetic brushes, etc.

Finally, the different cleaning action of the bristle ends and the flanks of the helixes can be advantageously combined in many cases. This e.g. applies with toothbrushes, massaging brushes, brooms, cylinder brooms, rust removing brushes, etc. In addition, screwlike bristles or such bristles combined into bundles can be used with particular advantage as interdental cleaners, which as a result of a reciprocating movement have a much better cleaning action in the interdental gaps, because continuously changing cross-sections come into action. Even if such an interdental cleaner jammed in narrow gaps, it would not tear off, but could instead be easily drawn out by twisting. Finally, a very gentle treatment can be obtained if the helix cross-section is correspondingly rounded.

In the case of an interdental cleaner, further advantages are obtained if it is only twisted over part of its length. The untwisted area has smaller cross-sectional dimensions and can therefore be more easily introduced into a gap between the teeth. Introduction can be further facilitated if the untwisted area at least zonally has a cross-section which is e.g. flattened by pressing.

In order to be able to adapt the action of a brush to given framework conditions, the screwlike bristles can be combined with bristles having other configurations and can be processed together.

I claim:

1. A method for the manufacture of screwlike bristles from plastic by the extrusion of monofilaments, wherein a monofilament having a non-circular cross-section is extruded and on drawing off is prestretched, accompanied by a reduction in its cross-section, then further stretched and then twisted over at least part of its length to a screwlike bristle material and, following twisting, is stabilized by heat shrinkage.

2. A method according to claim 1, wherein the monofilament is prestabilized by heat shrinkage after the further stretching and prior to twisting.

3. A method according to claim 1, wherein stabilization takes place by storing the wound, spiral bristle material.

4. A method according to claim 1, wherein a monofilament with an oval or polygonal cross-section is extruded.

5. A method according to claim 4, wherein a monofilament with a quadrangular cross-section is extruded.

6. A method according to claim 4, wherein a monofilament with a square cross-section is extruded.

7. A method according to claim 1, wherein the monofilament has a core and at least one axially parallel rib.

8. A method according to claim 7, wherein the monofilament has at least one edge of a polygonal cross-section and the at least one rib or the at least one edge of the polygonal cross-section has a different color than the core with differently colored plastics being extruded.

9. A method according to claim 8, wherein the core and the at least one rib or at least one edge are co-extruded from different plastics.

10. A method according to claim 1, wherein the monofilament is co-extruded from a core and a surrounding envelope of different plastics.

11. A method for the manufacture of screwlike bristles by extruding monofilaments, wherein at least two monofilaments are prestretched on drawing off, accompanied by a reduction of their cross-section, followed by further stretching and twisting together to give a spiral bristle material and are stabilized, after twisting, by heat shrinkage.

12. A method according to claim 11, wherein after further stretching, the monofilaments are prestabilized by heat shrinkage.

13. A method according to claim 5, wherein stabilization takes place by storing the wound bristle material at an elevated temperature.

14. A method according to claim 1, wherein the monofilament is made from an elastic plastic.

15. A method according to claim 1, wherein the monofilament is twisted with at least two turns per cm.

16. A method according to claim 11, wherein the monofilaments are twisted with at least two turns per cm.

17. A method according to claim 15, wherein the monofilament is twisted with three to five turns per cm.

18. A method according to claim 11, wherein the monofilaments are twisted with three to five turns per cm.

* * * * *